United States Patent [19]

Malek et al.

[11] Patent Number: 4,800,046

[45] Date of Patent: Jan. 24, 1989

[54] WATER JET AERATOR WITH DIVERTER VALVE

[75] Inventors: Jack H. Malek, Northridge; Stephen A. Markley, Santa Paula, both of Calif.

[73] Assignee: KDI American Products, Inc., Moorpark, Calif.

[21] Appl. No.: 121,442

[22] Filed: Nov. 17, 1987

[51] Int. Cl.[4] ..... A61H 33/02; F04F 5/44

[52] U.S. Cl. ..... 261/50.3; 261/DIG. 75; 239/414; 239/428.5; 239/587; 4/541; 4/542; 128/66; 137/894; 417/187

[58] Field of Search ..... 239/413, 414, 428.5, 239/587; 4/492, 541–544; 128/66; 137/894; 417/187; 261/50.3, DIG. 75

[56] References Cited

U.S. PATENT DOCUMENTS

| | | | |
|---|---|---|---|
| 4,335,854 | 6/1982 | Reynoso | 239/428.5 |
| 4,408,721 | 10/1983 | Cohen et al. | 239/428.5 X |
| 4,416,030 | 11/1983 | Reynoso | 239/428.5 X |
| 4,541,780 | 9/1985 | Moreland | 4/541 X |
| 4,542,853 | 9/1985 | Diamond | 239/428.5 X |
| 4,542,854 | 9/1985 | Mathis | 239/428.5 X |
| 4,671,463 | 6/1987 | Moreland et al. | 239/428.5 |

*Primary Examiner*—Douglas C. Butler
*Assistant Examiner*—Mary Beth O. Jones
*Attorney, Agent, or Firm*—Noel F. Heal; James M. Steinberger

[57] ABSTRACT

A water jet aerator in combination with a diverter valve including an aerator housing, a valve body that is rotatably positioned within the aerator housing, and a swivel nozzle. The aerator housing includes a water inlet conduit, a water outlet conduit, and an air inlet conduit, while the valve body forms two chambers, a diverter chamber and an aeration chamber. As the valve body is rotated in one direction within the aerator housing, water flow from the water inlet conduit to the aeration chamber is diverted to the water outlet conduit, while the air inlet conduit is proportionally closed to the aeration chamber. As the valve body is rotated in the other direction, water flow from the water inlet conduit to the water outlet conduit is diverted to the aeration chamber, while the air inlet conduit is proportionally opened to the aeration chamber. In this manner, water flow from the water inlet conduit can be completely diverted to the water outlet conduit and the other water jet aerators in the spa, or fully applied to the aeration chamber of the one water jet aerator for maximum massaging action of the user.

16 Claims, 4 Drawing Sheets

WATER JET AERATOR WITH DIVERTER VALVE

BACKGROUND OF THE INVENTION

This invention relates generally to spas and hot tubs and, more particularly, to water jet aerators used in spas and hot tubs.

Spas and hot tubs, which utilize jets of aerated water to provide their massaging action, generally have one or more water jet aerators spaced around the wall of the spa or hot tub for generating the jets of aerated water. One type of water jet aerator found in many spas and hot tubs mixes a stream of pressurized water with ambient air through a venturi type action. This venturi action takes place in an aeration chamber, with the air being pulled into the chamber from a passageway that is connected to the ambient atmosphere. The mixture of air and water is then discharged through a nozzle into the water contained in the spa or hot tub. The nozzle is often a swivel type nozzle, which allows the direction of the flow to be adjusted by the user of the spa or hot tub for maximum massaging action.

Many times, these adjustable venturi-type water jet aerators also include a flow control system for manually adjusting the flow of air and/or water. Several types of flow control systems have been utilized in the past. One type of flow control system adjusts only the water flow, with the air flow through the aerator remaining constant. A second type of flow control system adjusts both air and water flows simultaneously and proportionally. A third type of flow control system allows for independent adjustment of both air and water flows.

U.S. Pat. No. 4,541,780 to Moreland and U.S. Pat. No. 4,671,463 to Moreland et al. disclose a water jet aerator having a flow control system of the second type. The Moreland and Moreland et al. flow control systems each includes a valve body that is rotatably positioned in an aerator housing. The valve body has radially positioned air and water ports and the aerator housing has air and water inlets. When the valve body is rotated relative to the aerator housing, the air and water inlets in the aerator housing are opened or closed proportionally by the alignment of the ports in the valve body relative to the inlets in the housing. The specific proportion of air to water can be varied by altering the shape and spacing of the air and water ports in the valve body and the shape and spacing of the air and water inlets in the aerator housing.

U.S. Pat. No. 4,335,854 to Reynoso discloses a water jet aerator having a flow control system of the third type. The Reynoso flow control system includes a pair of concentric tubular sleeves that are rotatably positioned in an aerator housing. The sleeves have radially positioned air and water inlets. When the sleeves are rotated relative to the aerator housing, the air and water inlets in the aerator housing are opened or closed by the alignment of the ports in the sleeve relative to the inlets in the housing. The Reynoso jet aerator also includes a restrictor ring for adjusting the flow of aerated water from the water jet aerator. Another water jet aerator having a flow control system of the third type is disclosed in U.S. Pat. No. 4,542,854 to Mathis.

In a typical ganged installation of water jet aerators in a spa or hot tub, several aerators are spaced around the wall of the spa or hot tub to form a parallel circuit. The air inlets in the aerator housings are joined to a common air manifold, which can be vented to the atmosphere or connected to the outlet of a blower. Similarly, the water inlets are coupled to a water manifold supplied with pressurized water from a pump. Valves may or may not be placed in the individual water lines that run to the water inlets in each aerator housing. However, in either case, this type of installation does not lend itself to easily allowing the spa user to divert water flow from one water jet aerator to another. Accordingly, there has been a need for an improved water jet aerator that allows water flow to be easily diverted among the several aerators. The present invention clearly fulfills this need.

SUMMARY OF THE INVENTION

The present invention resides in a water jet aerator in combination with a diverter valve. In a presently preferred embodiment of the invention, the water jet aerator includes a tubular-shaped aerator housing, a tubular-shaped valve body that is rotatably positioned within the aerator housing, and a swivel nozzle that is rotatably attached to the front of the valve body. The aerator housing includes a water inlet conduit, a water outlet conduit, and an air inlet conduit, while the valve body forms two chambers, a diverter chamber and an aeration chamber. As the valve body is rotated in one direction within the aerator housing, water flow from the water inlet conduit to the aeration chamber is diverted to the water outlet conduit, while the air inlet conduit is proportionally closed to the aeration chamber. As the valve body is rotated in the other direction, water flow from the water inlet conduit to the water outlet conduit is diverted to the aeration chamber, while the air inlet conduit is proportionally opened to the aeration chamber. In this manner, water flow from the water inlet conduit can be completely diverted to the water outlet conduit and the other water jet aerators in the spa, or fully applied to the aeration chamber and swivel nozzle of the one water jet aerator for maximum massaging action of the user of the one jet aerator. Of course, any range of proportional water flows between the two is also possible.

The water inlet and outlet conduits are positioned diametrically opposite each other, while the axis of the air inlet conduit is positioned perpendicular to and forward of the axes of the two water conduits. The valve body has radially positioned air ports and water ports. The air ports open into the aeration chamber and the water ports open into the diverter chamber. The air and water ports are positioned diametrically opposite each other, respectively, and are alignable with their respective air and water inlet conduits in the aerator housing by rotating the valve body. A water conduit, which supplies water from the water inlet conduit to the aeration chamber, has a radially-positioned opening in the valve body with an axis that is perpendicular to the axes of the water ports. This conduit opening is also alignable with the water inlet conduit. The outlet of the conduit is along the longitudinal axis of the valve body in the aeration chamber. As the valve body is rotated within the aerator housing, the air and water ports and the conduit opening move into and out of alignment with their respective water and air inlet conduits in the aerator housing, thus controlling the flow of water and air to the aeration chamber and the flow of water to the water outlet conduit.

It will be appreciated from the foregoing that the present invention represents a significant advance in the field of water jet aerators. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENTS

Figure 1:
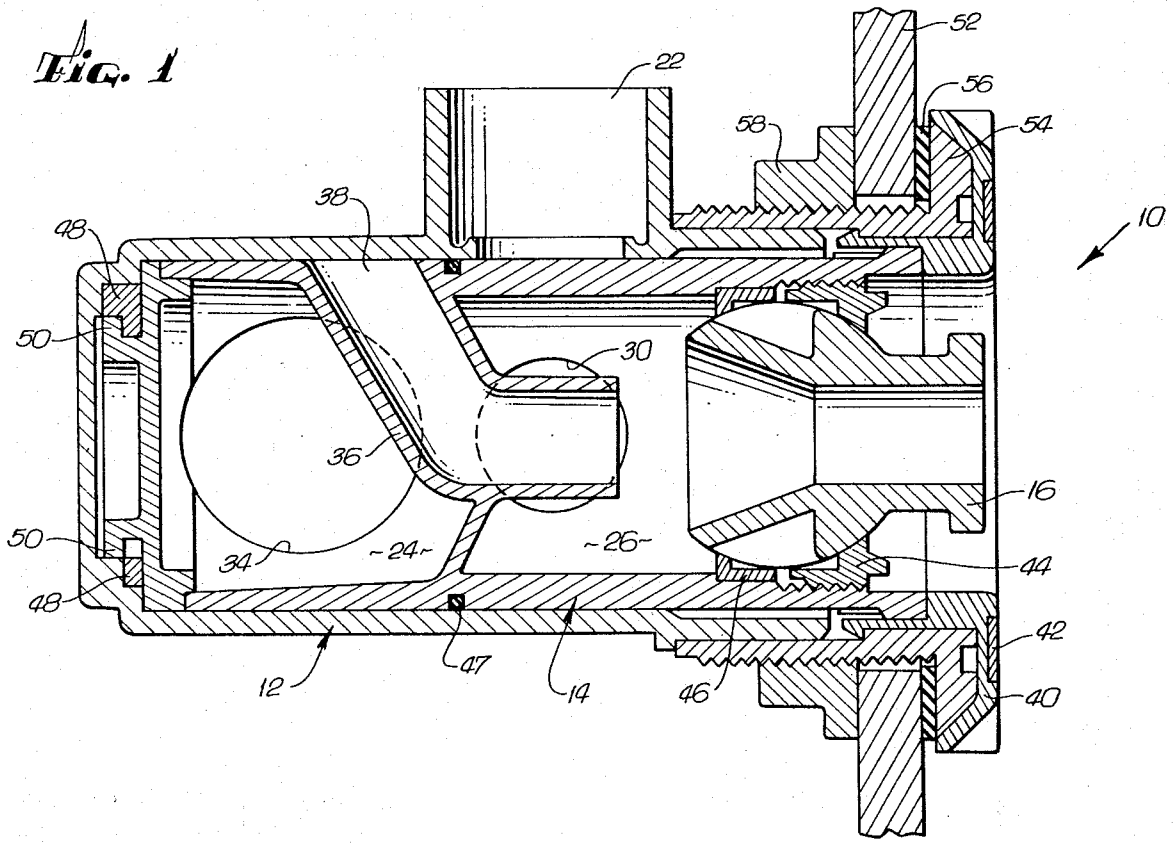
FIG. 1 is a cross-sectional view of a water jet aerator with diverter valve in accordance with the present invention.
Figure 2:
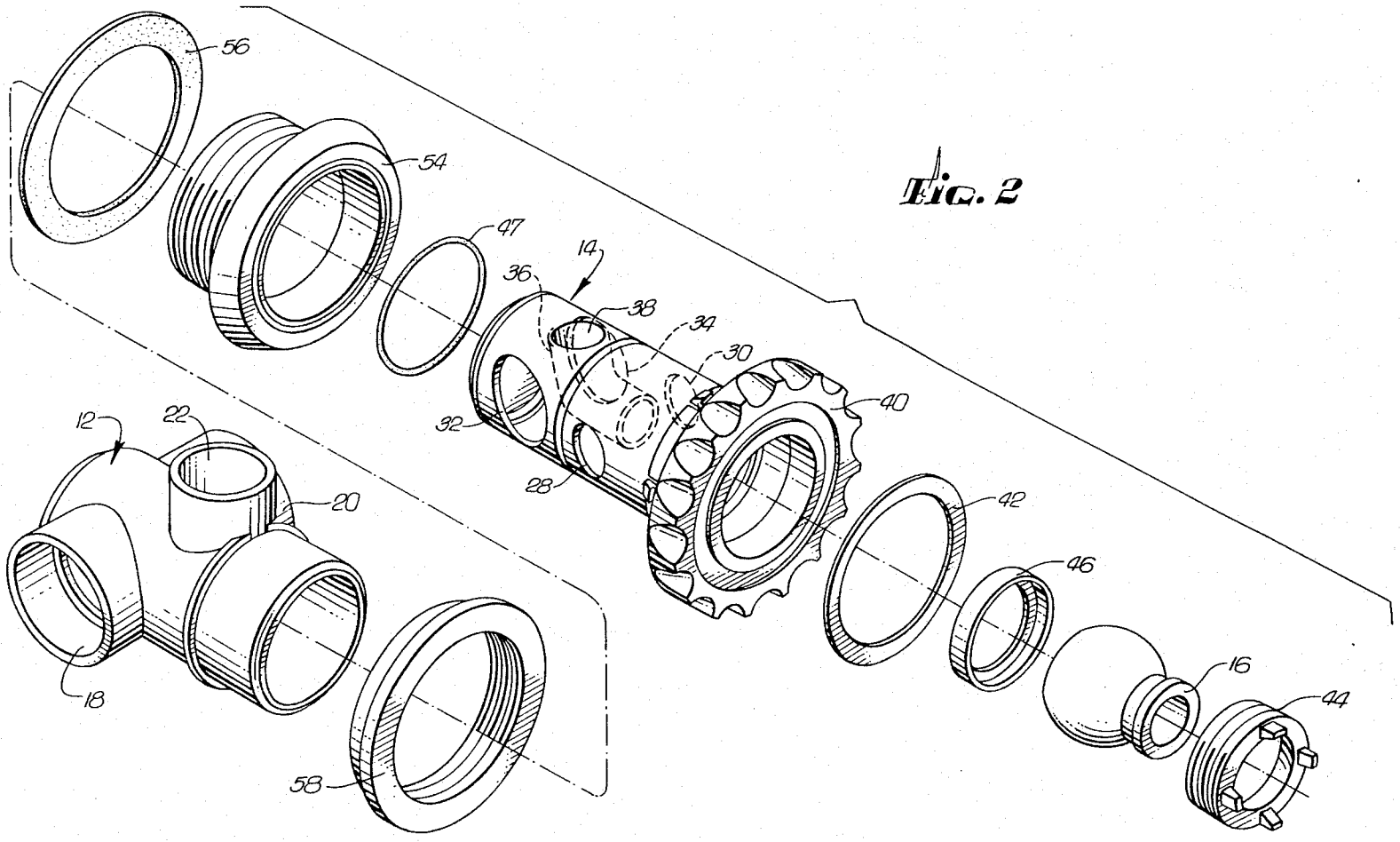
FIG. 2 is an exploded perspective view of the water jet aerator with diverter valve, showing a valve body and an aerator housing.
Figure 3:
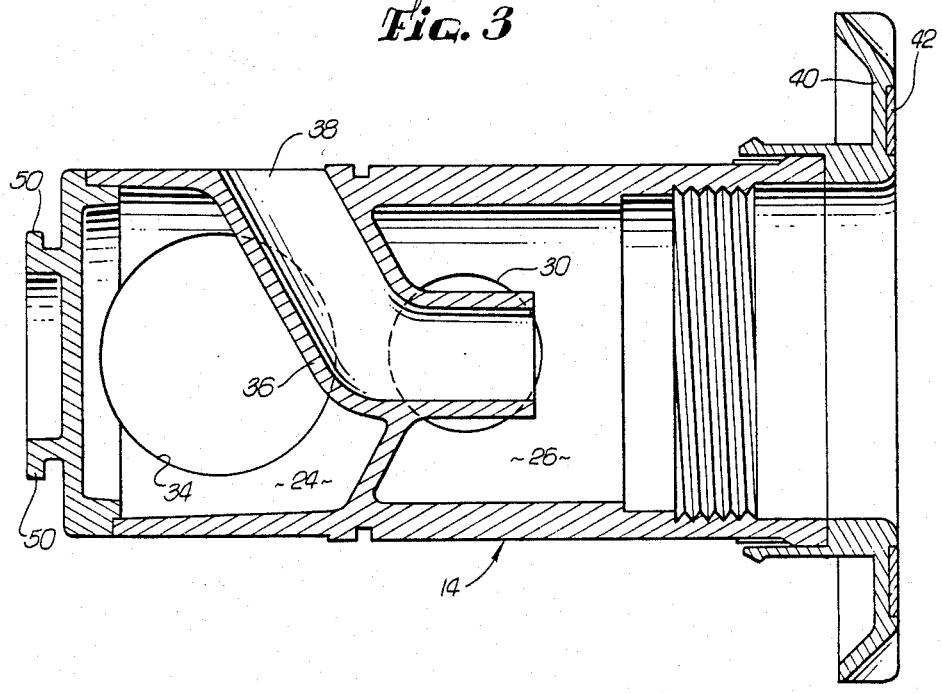
FIG. 3 is a cross-sectional view of the valve body.

In accordance with a presently preferred embodiment of the invention, as shown in FIGS. 1-2, a water jet aerator with diverter valve 10 includes a tubular-shaped aerator housing 12, a tubular-shaped valve body 14 that is rotatably positioned within the aerator housing 12, and a swivel nozzle 16 that is rotatably attached to the front of the valve body 14. The aerator housing 12 includes a water inlet conduit 18, a water outlet conduit 20 (FIG. 4), and an air inlet conduit 22. As shown in FIGS. 1 and 3, the valve body 14 forms two chambers, a diverter chamber 24 and an aeration chamber 26. As the valve body 14 is rotated in one direction within the aerator housing 12, water flow from the water inlet conduit 18 to the aeration chamber 26 and swivel nozzle 16 is diverted to the water outlet conduit 20, while the air inlet conduit 22 is proportionally closed to the aeration chamber 26. As the valve body 14 is rotated in the other direction, water flow from the water inlet conduit 18 to the water outlet conduit 20 is diverted to the aeration chamber 26 and swivel nozzle 16, while the air inlet conduit 22 is proportionally opened to the aeration chamber 26. In this manner, water flow from the water inlet conduit 18 can be completely diverted to the water outlet conduit 20 and the other water jet aerators in the spa, or fully applied to the aeration chamber 26 and swivel nozzle 16 of water jet aerator 10 for maximum massaging action of the user of the one jet aerator. Of course, any range of proportional water flows between the two is also possible.

Figure 4:
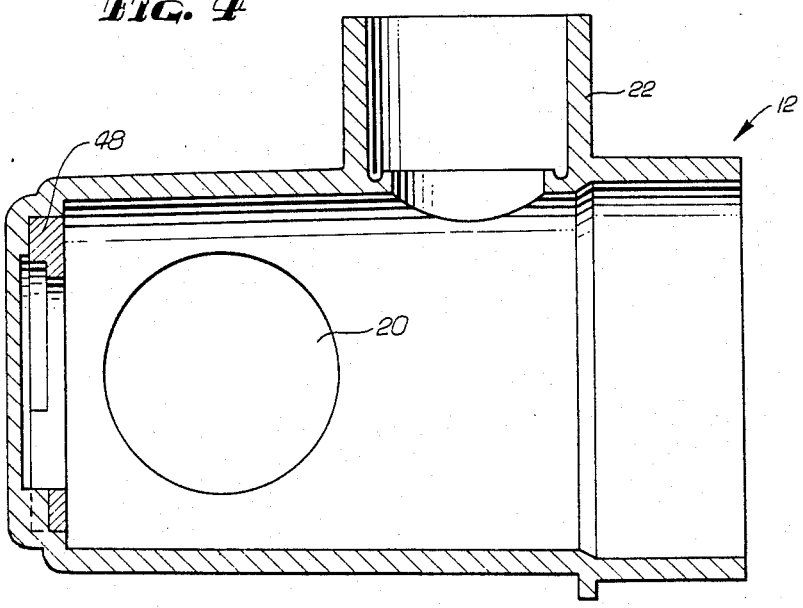
FIG. 4 is a cross-sectional view of the aerator housing.

As shown in FIGS. 2 and 4, the water inlet and outlet conduits 18, 20 are positioned diametrically opposite each other, while the axis of the air inlet conduit 22 is positioned perpendicular to and forward of the axes of the two water conduits 18, 20. As shown in FIGS. 2 and 3, the valve body 14 has radially positioned air ports 28, 30 and water ports 32, 34. The air ports 28, 30 open into the aeration chamber 26 and the water ports 32, 34 open into the diverter chamber 24. The air and water ports 28, 30, 32, 34 are positioned diametrically opposite each other, respectively, and are alignable with their respective air and water inlet conduits 22, 18 in the aerator housing 12 by rotating the valve body 14. A water conduit 36, which supplies water from the water inlet conduit 18 to the aeration chamber 26, has a radially-positioned opening 38 in the valve body 14 with an axis that is perpendicular to the axes of the water ports 32, 34. The opening 38 is also alignable with the water inlet conduit 18. The outlet of the conduit 38 is along the longitudinal axis of the valve body 14 in the aeration chamber 26. As the valve body 14 is rotated within the aerator housing 12, the air and water ports 28, 30, 32, 34 and opening 38 move into and nout of alignment with their respective water and air inlet conduits 18, 22 in housing 12, thus controlling the flow of water and air to the aeration chamber 26 and the flow of water to the water outlet conduit 20.

As shown in FIGS. 2 and 3, the front end of the valve body 14 is provided with a scalloped flange 40, allowing the valve body 14 to be easily rotated by the user of the spa. A decorative ring 42, such as polished brass or stainless steel, can be attached to the front of the flange. As shown in FIGS. 1 and 2, the swivel nozzle 16 is rotatably attached to the front of the valve body 14 with a ring nut 44 and a nozzle retainer ring 46. The ring nut 44 and retainer ring 46 seal the aeration chamber 26 to prevent leaks from the front of the valve body 14, and also allow the nozzle to be easily swiveled. An O-ring 47 prevents leakage between the diverter chamber 24 and the aeration chamber 26.

Figure 5:
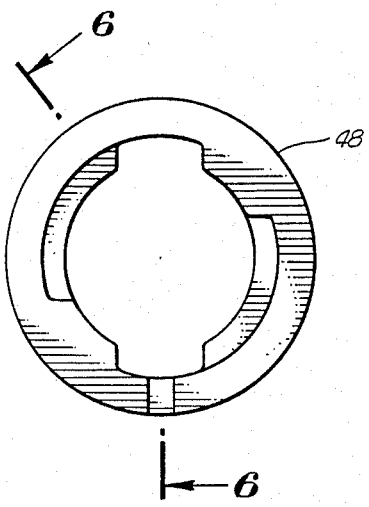
FIG. 5 is a rear elevational view of a locking mechanism used in rotatably securing the valve body to the aerator housing.
Figure 6:
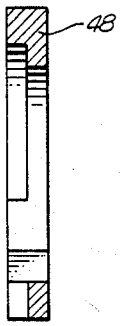
FIG. 6 is a cross-sectional view of the locking mechanism taken along the line 6—6 of FIG. 5.
Figure 7:
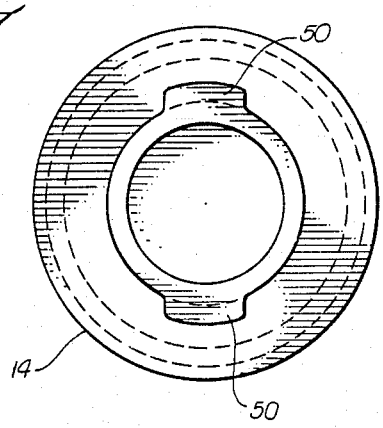
FIG. 7 is a rear elevational view of the valve body showing a pair of locking tabs that engage the locking mechanism.

As shown in FIG. 1, a locking mechanism 48 rotatably secures the valve body 14 to the back of the aerator housing 12. As shown in FIGS. 3 and 7, a pair of locking tabs 50 at the back of the valve body 14 engage the locking mechanism 48 to secure the valve body 14 to the housing 12. As shown in Figures 5 and 6, the locking mechanism 48 also limits rotation of the valve body to ninety degrees, thus preventing the water inlet conduit 18 from being inadvertently closed. This would occur if the valve body 14 were rotated to a position such that opening 38 was aligned with the water outlet conduit 20.

Because the present invention will work equally well with the water inlet conduit 18 on the left or the right side of the aerator housing 12, the valve body 14 must be inserted into the housing 12 with opening 38 on the same side as the inlet conduit 18. Otherwise, the water inlet conduit 18 can be inadvertently closed. One possible solution to this problem is to slightly reduce the outer diameter of the back portion of the valve body 14, thus providing a water bypass from the water inlet conduit 18 to the outlet conduit 20 if the valve body 14 is inserted incorrectly.

As shown in FIGS. 1 and 2, the water jet aerator 10 is attached to a wall 52 of a spa or hot tub with a threaded sleeve 54, a gasket 56, and a hex mounting nut 58. In the presently preferred embodiment of the present invention, the aerator 10 is preferably fabricated from ABS, except the O-ring 47 and gasket 56, which are fabricated from a rubber material, and the aerator housing 12, the locking mechanism 48, and the threaded sleeve 54, which are fabricated from PVC.

From the foregoing, it will be appreciated that the present invention represents a significant advance in the field of water jet aerators. Although several preferred embodiments of the invention have been shown and described, it will be apparent that other adaptations and modifications can be made without departing from the spirit and scope of the invention. Accordingly, the invention is not to be limited, except as by the following claims.

We claim:

1. An improved water jet aerator, comprising:

an aerator housing having a water inlet conduit, a water outlet conduit and an air inlet conduit; and a valve body rotatably positioned within the aerator housing, the valve body having an aeration chamber;

wherein as the valve body is rotated in one direction water flow from the water inlet conduit is diverted to the water outlet conduit and the air inlet is proportionally closed to the aeration chamber and as the valve body is rotated in the other direction water flow from the water inlet conduit to the water outlet conduit is diverted to the aeration chamber and the air inlet is proportionally opened to the aeration chamber.

2. The improved water jet aerator as set forth in claim 1, wherein the valve body includes a diverter chamber for diverting the water flow to the water outlet conduit.

3. The improved water jet aerator as set forth in claim 2, wherein the valve body includes a water conduit for diverting the water flow to the aeration chamber.

4. The improved water jet aerator as set forth in claim 3, wherein the valve body includes radiallypositioned air and water ports, the air ports opening into the aeration chamber and the water ports opening into the diverter chamber.

5. The improved water jet aerator as set forth in claim 4, wherein the water inlet and outlet conduits are positioned diametrically opposite each other and the axis of the air inlet conduit is positioned perpendicular to and forward of the axes of the water inlet and outlet conduits.

6. The improved water jet aerator as set forth in claim 5, wherein the air ports are positioned diametrically opposite each other and are alignable with the air inlet conduit and the water ports are positioned diametrically opposite each other and are alignable with the water inlet and outlet conduits.

7. The improved water jet aerator as set forth in claim 6, wherein the water conduit has a radiallypositioned opening in the valve body with an axis that is perpendicular to the axes of the water ports, the opening being alignable with the water inlet conduit.

8. The improved water jet aerator as set forth in claim 7, wherein the outlet of the water conduit is along the longitudinal axis of the valve body in the aeration chamber.

9. An improved water jet aerator, comprising:

a tubular-shaped aerator housing having a water inlet conduit, a water outlet conduit and an air inlet conduit;

a tubular-shaped valve body rotatably positioned within the aerator housing, the valve body having a diverter chamber, an aeration chamber and a water conduit;

a locking mechanism for rotatably securing the valve body to the aerator housing; and a swivel nozzle rotatably attached to the front of the valve body;

wherein as the valve body is rotated in one direction water flow from the water inlet conduit is diverted by the divertere chamber to the water outlet conduit and the air inlet is proportionally closed to the aeration chamber and as the valve body is rotated in the other direction water flow from the water inlet conduit to the water outlet conduit is diverted by the water conduit to the aeration chamber and the air inlet is proportionally opened to the aeration chamber.

10. The improved water jet aerator as set forth in claim 9, wherein the valve body includes radially-positioned air and water ports, the air ports opening into the aeration chamber and the water ports opening into the diverter chamber.

11. The improved water jet aerator as set forth in claim 10, wherein the water inlet and outlet conduits are positioned diametrically opposite each other and the axis of the air inlet conduit is positioned perpendicular to and forward of the axes of the water inlet and outlet conduits.

12. The improved water jet aerator as set forth in claim 11, wherein the air ports are positioned diametrically opposite each other and are alignable with the air inlet conduit and the water ports are positioned diametrically opposite each other and are alignable with the water inlet and outlet conduits.

13. The improved water jet aerator as set forth in claim 12, wherein the water conduit has a radially-positioned opening in the valve body with an axis that is perpendicular to the axes of the water ports, the opening being alignable with the water inlet conduit.

14. The improved water jet aerator as set forth in claim 13, wherein the outlet of the water conduit is along the longitudinal axis of the valve body in the aeration chamber.

15. The improved water jet aerator as set forth in claim 9, wherein the valve body includes a pair of locking tabs for engaging the locking mechanism, thereby securing the valve body to the housing.

16. The improved water jet aerator as set forth in claim 9, wherein the locking mechanism limits rotation of the valve body to approximately ninety degrees.

* * * * *